US006595703B1

(12) United States Patent
Laituri et al.

(10) Patent No.: US 6,595,703 B1
(45) Date of Patent: Jul. 22, 2003

(54) CAMERA WITH DUAL-PURPOSE CARRY STRAP

(75) Inventors: David Laituri, Wayland, MA (US); Scott Lauffer, Austin, TX (US); Jeffrey Michael, Cambridge, MA (US); Scott Stropkay, Carlisle, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 10/078,654

(22) Filed: Feb. 19, 2002

(51) Int. Cl.[7] ..... G03B 17/00; G03B 17/02
(52) U.S. Cl. ..... 396/423; 396/535
(58) Field of Search ..... 396/423, 420, 396/419, 421, 535; 206/316.2; 224/516, 578

(56) References Cited

U.S. PATENT DOCUMENTS 5,307,966 A * 5/1994 Inaba et al. ..... 224/578
5,680,977 A 10/1997 Burke ..... 224/576
5,782,353 A 7/1998 Barclay et al. ..... 206/316.2
5,805,944 A 9/1998 Barclay et al. ..... 396/422
5,812,885 A 9/1998 Noguchi et al. ..... 396/29
6,064,823 A 5/2000 Solomon ..... 396/6
6,134,388 A 10/2000 Balling et al. ..... 396/6
6,264,379 B1 7/2001 Rydelek et al. ..... 396/423

* cited by examiner

*Primary Examiner*—Russell Adams
*Assistant Examiner*—Rochelle Blackman

(57) ABSTRACT

A camera is disclosed which has a housing and a carry strap attached to the housing. The strap has a first position and a second position wherein the first position permits the carry strap to be longitudinally extended from the housing as a closed loop to receive one's hand in said closed loop. The second position is created by drawing the carry strap laterally from the housing to create a positioning loop to permit a portion of the hand to pass through while in mechanical contact with the housing.

4 Claims, 1 Drawing Sheet

CAMERA WITH DUAL-PURPOSE CARRY STRAP

BACKGROUND OF THE INVENTION

The invention relates generally to the field of photography, and in particular to cameras with carry or wrist straps. More specifically, the invention relates to a camera with dual-purpose carry strap and positioning strap.

It is well known for a camera to include a flexible carry or wrist strap. The carry strap is attached to the housing of a camera to permit the carry strap to be longitudinally extended from the housing as a closed loop, to receive one's hand, wrist or neck in the closed loop.

It is also common for a camera to have a positioning strap attached to a lateral surface. The positioning strap is secured to the camera via a lug to permit the carry-strap to extend as a loop from the camera. The positioning strap allows the upper part of the hand to pass through such that the camera is held tight to the palm of the hand. The fingers of the hand are then above the strap while the thumb stays below, allowing the hand to operate the camera while the strap steadies the camera against the hand.

SUMMARY

The aforementioned and other objects are achieved by the invention, which provides a dual-purpose carry strap for use with a camera.

A camera is disclosed which has a housing and a carry strap attached to the housing. The strap has a first position and a second position wherein the first position permits the carry strap to be longitudinally extended from the housing as a closed loop to receive one's hand in said closed loop. The second position is created by drawing the carry strap laterally from the housing to create a positioning loop to permit a portion of the hand to pass through while in mechanical contact with the housing.

The aforementioned and other aspects of the invention are evident in the drawings and in the description that follows.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION

While the present invention retains utility within a wide variety of consumer electronic devices and may be embodied in several different forms, it is advantageously employed in connection with a camera. Though this is the form of the preferred embodiment and will be described as such, this embodiment should be considered illustrative and not restrictive.

The invention is disclosed as being embodied preferably in a camera with a carry or wrist strap. Because the features of a camera with a carry or wrist strap are generally known, the description which follows is directed in particular only to those elements forming part of or cooperating directly with the disclosed embodiment. It is to be understood, however, that other elements may take various forms known to a person of ordinary skill in the art.

Figure 1:
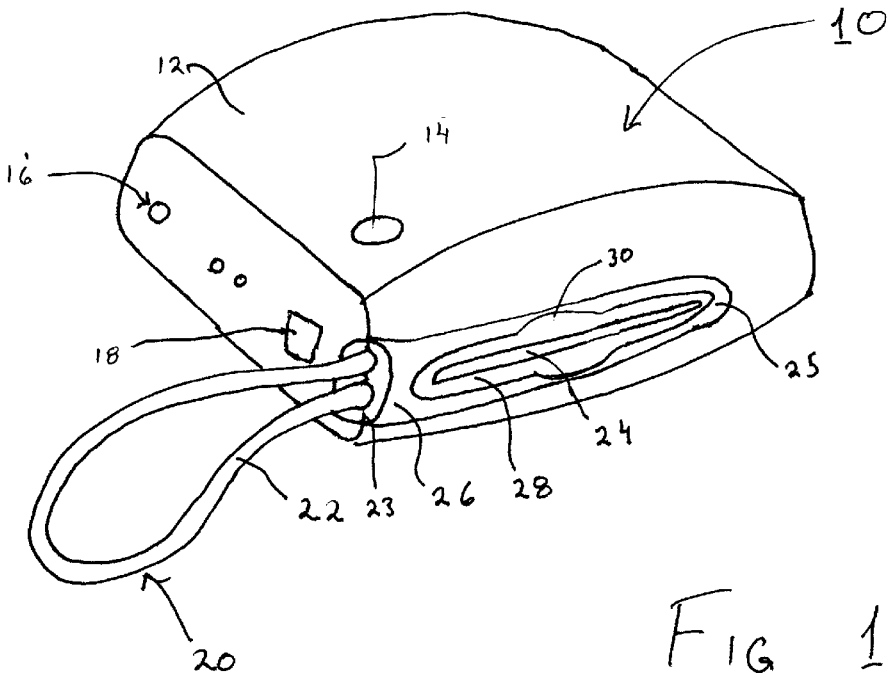
FIG. 1 is a rear perspective view of a camera with a carry strap according to a preferred embodiment of the invention, showing the carry strap longitudinally extended from a housing of the camera as a closed loop to receive one's hand in the closed loop.
Figure 2:
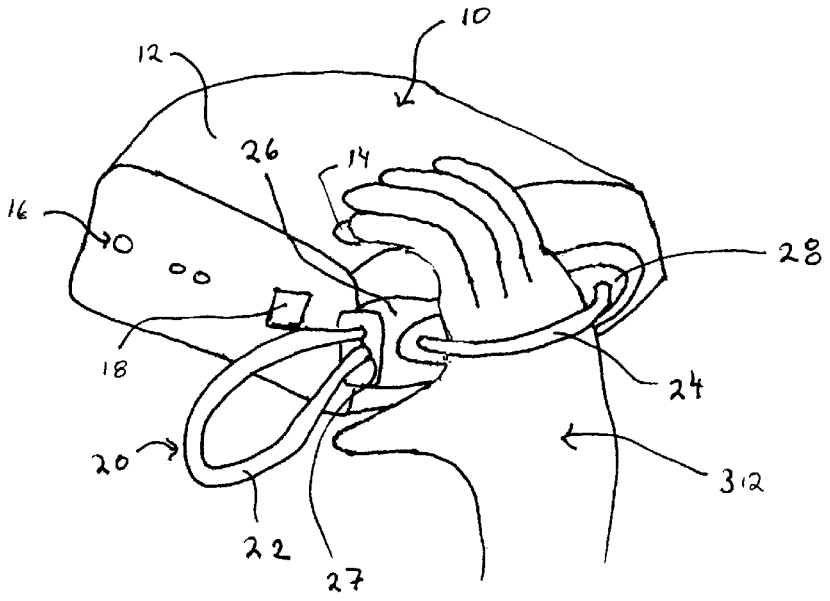
FIG. 2 is a rear perspective view of the camera with the carry strap, showing the carry strap extended laterally in its second position to secure one's hand in mechanical contact with the housing.

Referring now to the drawings, FIGS. 1 and 2 show a camera 10 comprising a housing 12 that is adapted to hold film and an optical system for exposing the film. The housing 12 in the preferred embodiment has an actuation button 14 for triggering the optical system to expose the film and a set of controls 16 to adjust the optical system. Also disposed in the housing is a viewfinder 18, which allows the user to view what the optical system will present to the film.

Secured to the housing is a strap 20. FIG. 1 shows the strap 20 longitudinally extended from a housing 12 of the camera 10 such that the carrier portion 22 of the strap 20 forms a closed loop to receive one's hand in the closed loop. In other embodiments, the strap 20 may be further elongated such that the carrier portion 22 may be used as a neck strap or may be elastic.

The strap is mechanically secured to the housing by a mount 26. The mount 26 permanently fixes one end of the strap 20 within the mount 26 in a rear portion 23 of the mount and fixes the other end of the strap 20 in a front portion 25 of the mount. Therebetween, the mount 26 provides a friction fit such that the positioning portion 24 of the strap 20 is held with sufficient resistance to keep it from freely sliding.

The positioning portion 24 of the strap 20 is disposed in a cutaway portion 28 of the mount 26. The cutaway portion 28 of the mount 26 receives the positioning portion 24 of the strap 20 when disposed in the carry position and provides a comfortable hand position when extended into its second position. Recesses 30 are cut into the cut away portion 28 of the mount 26 to provide a user easy access to the positioning portion 24 of the strap 20 to actuate the strap into the second position.

FIG. 2 shows the carry strap extended laterally in its second position to secure a user's hand in mechanical contact with the housing. By gripping the positioning portion 24 of the strap 20 through the recesses 30, the user pulls the strap through a port 27 in the mount. The port 27 is sized so as to create a frictional interface with the strap. Thus, the user must pull the strap 20 with sufficient force as to overcome the frictional resistance which draws the strap 20 through the port 27 reducing the size of the carrier portion 22 of the strap 20 and increasing the positioning portion 24 of the strap.

Once withdrawn from the mount 26, a hand 32 may be placed between the positioning portion 24 of the strap 20 and the housing 12. This hand position allows the user to access the actuation button 14 while holding the camera 10. Pulling the carrier portion 22 of the strap 20 through the port 27 in a like manner to that described above then tightens the positioning 24 portion of the strap 20 against the back of the hand 32 thereby securing the camera 10 against the hand 32.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes that come within the meaning and range of equivalency of the claims are therefore intended to be embraced therein.

The embodiments of the invention in which an exclusive property or privilege is claimed are defined as follows:

1. A camera having a strap assembly moveable between carrying and positioning configurations, said camera comprising:

a camera housing;

an elongated flexible strap having opposed first and second ends; and a strap mount fixedly mounted on the camera housing, the mount having first and second opposed end portions, the first end portion including means for receiving and fixing the first end of the strap to the mount, the second end portion including means for receiving and fixing the second end of the strap to the mount, and a frictional holding force applying strap holder, located between the first and second mount end portions, through which a portion of the strap between its first and second ends is threaded, the strap holder being in frictional engagement with the portion of the strap threaded therethrough to releasably hold the strap portion in the holder but allowing the strap to slide through the holder when sufficient pulling force is applied to the strap to overcome the frictional holding force;

wherein the strap is movable to a carrying configuration by the user pulling the strap through the holder in one direction to form a longitudinally extending closed loop for receiving the user's hand to carry the camera and is moveable to the positioning configuration by the user pulling the strap through the holder in a second direction, opposite the first direction, to form a closed laterally extending positioning loop between the first and second ends of the mount through which the user may extend one hand and grasp the camera housing and then pull the strap back through the holder in the one direction with the users other hand to tighten the positioning loop against the back of the user's hand therein to position and hold the hand firmly against the camera housing.

2. The camera set forth in claim 1 wherein the mount includes a channel for receiving a portion the strap pressed against the mount when the strap is in the carrying configuration.

3. The camera of claim 2 further including a recess in the mount providing access for grasping a portion of the strap and pulling it outwardly from the channel to form the positioning loop.

4. The camera of claim 1 wherein the camera housing has a camera actuating control thereon and the strap mount is mounted on the camera housing so that the user's fingers on the hand in the positioning loop are located in position to operate the camera actuation control.

* * * * *